US009475327B2

(12) United States Patent
Izawa et al.

(10) Patent No.: US 9,475,327 B2
(45) Date of Patent: Oct. 25, 2016

(54) TRANSFER INKJET PRINTER DEVICE

(71) Applicants: Hideo Izawa, Narashino (JP); Takao Namiki, Narashino (JP); Junichi Setoyama, Narashino (JP)

(72) Inventors: Hideo Izawa, Narashino (JP); Takao Namiki, Narashino (JP); Junichi Setoyama, Narashino (JP)

(73) Assignee: Miyakoshi Printing Machinery Co., Ltd., Narashino-shi (JP)

( * ) Notice: Subject to any disclaimer, the term of this patent is extended or adjusted under 35 U.S.C. 154(b) by 0 days.

(21) Appl. No.: 14/170,813

(22) Filed: Feb. 3, 2014

(65) Prior Publication Data

US 2014/0225966 A1 Aug. 14, 2014

(30) Foreign Application Priority Data

Feb. 14, 2013 (JP) ..... 2013-027082

(51) Int. Cl.
*B41M 5/03* (2006.01)
*B41J 2/01* (2006.01)

(52) U.S. Cl.
CPC . *B41M 5/03* (2013.01); *B41J 2/01* (2013.01); *B41J 2002/012* (2013.01); *B41J 2202/04* (2013.01)

(58) Field of Classification Search
None
See application file for complete search history.

(56) References Cited

U.S. PATENT DOCUMENTS 6,126,274 A * 10/2000 Kohyama ..... 347/55
2003/0067529 A1* 4/2003 May et al. ..... 347/103
2004/0086603 A1* 5/2004 Shastry ..... A21D 13/0087 426/104
2011/0262192 A1* 10/2011 Okamoto ..... D06P 1/0004 399/314
2012/0154497 A1* 6/2012 Nakao et al. ..... 347/102

FOREIGN PATENT DOCUMENTS

JP 05-261903 A 10/1993
JP 05261904 A 10/1993
JP 2003-228222 A 8/2003
JP 2009073046 A 4/2009
JP 2009538758 A 11/2009

OTHER PUBLICATIONS

European Patent Office, Extended European Search Report issued in corresponding European Patent Application No. 14152765.5 (May 2, 2014) (6 pages).
Japanese Patent Office, Office Action Issued in Japanese Application No. 2013-027082 Mailed Jul. 12, 2016, 8 pages.

* cited by examiner

*Primary Examiner* — Bradley Thies
(74) *Attorney, Agent, or Firm* — Wood Herron & Evans LLP

(57) ABSTRACT

The transfer inkjet printer device includes an intermediate transfer body including an intermediate transfer surface capable of moving along a rotation route; an inkjet head used to discharge ink including toner particles onto the intermediate transfer surface at a first area in the rotation route in a state where the toner particles are charged, so as to form an intermediate image composed of an ink layer on the intermediate transfer surface; a pressure device used to press the ink layer of the intermediate image on the intermediate transfer surface, onto a surface of a recording medium at a second area in the rotation route; and an electric field application device used to electrophorese the charged toner particles in the ink layer of the intermediate image toward the recording medium at the second area.

9 Claims, 4 Drawing Sheets

TRANSFER INKJET PRINTER DEVICE

TECHNICAL FIELD

The present invention relates to a transfer inkjet printer device. Priority is claimed on Japanese Patent Application No. 2013-27082, filed Feb. 14, 2013, the contents of which are incorporated herein by reference.

BACKGROUND ART

In the related art, as one of printing methods, a transfer inkjet printing method is known. In this transfer inkjet printing method, ink including toner particles is discharged onto the surface of an intermediate transfer body such as a transfer belt or a transfer roller using an inkjet method, to form an intermediate image thereon, and the intermediate image is transferred onto the surface of a recording medium such as paper or various sheets, to form a final image on the recording medium. As a recording medium, a paperboard, carton paper, a resin sheet, cloth or the like is used.

As a device (transfer inkjet printer device) to carry out such a transfer inkjet printing method, a device disclosed in, for example, Japanese Unexamined Patent Application, First Publication No. H5-261903, or Japanese Unexamined Patent Application, First Publication No. 2003-228222, is already proposed. Both transfer inkjet printer devices disclosed in these Patent Documents have a configuration in which an ink layer of an intermediate image formed on the surface of an intermediate transfer body such as a transfer belt or a transfer roller using an inkjet head is pressed onto the surface of a recording medium such as paper or various sheets using mechanical pressure, thereby transferring the intermediate image onto the surface of the recording medium.

In a transfer inkjet printer device in the related art, depending on types of recording medium or on surface properties thereof, it may become difficult to form a high-quality print image on the surface of the recording medium. With respect to a print image, for example, it is desired that the print image is accurate and clear, the unevenness of color or shade is small, and the image reproducibility is excellent. In addition, it is desired that the adhesion of an ink layer to the surface of a recording medium is high, and the durability of the ink layer is excellent. However, in a transfer inkjet printer device in the related art, depending on types of recording medium or on surface properties thereof, it may become difficult to form a high-quality print image on the surface of the recording medium, wherein the print image sufficiently fulfills these requirements. For example, in a case where a recording medium having low wettability to inkjet ink, a fluffy recording medium having low surface smoothness (a recording medium having a rough surface) or the like is used, it may not be able to form a high-quality print image which fulfills all the above requirements.

The present invention was made in view of the above circumstances and aims to provide a transfer inkjet printer device capable of reliably and stably forming a print image on a recording medium without reference to types of recording medium or to surface properties thereof, wherein the print image is accurate and clear, the unevenness of color or shade is small, the image reproducibility is excellent, the adhesion of an ink layer to the surface of the recording medium is high, and the durability of the ink layer is excellent.

SUMMARY OF INVENTION

The inventor found that in a transfer inkjet printer device using pigment-based ink, when an intermediate image formed on the surface of an intermediate transfer body such as a transfer belt using an inkjet method is transferred onto a recording medium, not only by pressing the intermediate transfer body provided with an ink layer, but also by moving and gathering toner particles (charged particles) in the ink layer of the intermediate image toward the surface of the recording medium using electrophoresis, the above-described problems can be solved, and thus the inventor completed the present invention.

That is, in a printer device of an inkjet method of the present invention, toner particles (colored pigment particles) in a dispersion medium have been charged when ink is discharged from an inkjet head, and thus the toner particles in an ink layer of an intermediate image are also in a charged state. Therefore, by applying an electric field to a transfer area when the intermediate image is transferred to a recording medium, it is possible to move and gather the toner particles into a position in the ink layer near the recording medium using electrophoresis.

In a first aspect of the present invention, a transfer inkjet printer device includes an intermediate transfer body including an intermediate transfer surface capable of rotationally moving along a rotation route; an inkjet head used to discharge ink made by dispersing toner particles having a property to be charged in a dispersion medium, onto the intermediate transfer surface of the intermediate transfer body at a first area in the rotation route in a state where the toner particles are charged, so as to form an intermediate image composed of an ink layer on the intermediate transfer surface; a pressure device used to press the ink layer of the intermediate image on the intermediate transfer surface, onto a surface of a recording medium at a second area in a downstream side of the first area in the rotation route; and an electric field application device used to electrophorese the charged toner particles in the ink layer of the intermediate image on the intermediate transfer surface, toward the recording medium at the second area.

In a second aspect of the present invention, the transfer inkjet printer device of the first aspect further includes a charger used to charge the toner particles in the ink layer of the intermediate image on the intermediate transfer surface at a position in a downstream side of the first area and in an upstream side of the second area in the rotation route.

In a third aspect of the present invention, in the transfer inkjet printer device of the first or second aspect, the intermediate transfer body is composed of a strip-shaped transfer belt formed into an endless annular shape, and an outer surface of the transfer belt includes the intermediate transfer surface. The pressure device includes a pressure roller and a support roller which are configured to rotate while inserting the transfer belt and the recording medium therebetween at the second area in a state where the transfer belt and the recording medium are lapped on each other. In addition, the electric field application device is configured to apply an electric field between the pressure roller and the support roller.

In a fourth aspect of the present invention, in the transfer inkjet printer device of the third aspect, the transfer belt has a configuration in which a surface of a base material formed of urethane rubber is covered with a fluorine-based resin.

In a fifth aspect of the present invention, in the transfer inkjet printer device of the first or second aspect, the intermediate transfer body is composed of a cylindrical transfer roller, an outer peripheral surface of the transfer roller includes the intermediate transfer surface, and the pressure device includes a pressure roller. The transfer roller and the pressure roller are configured to rotate while inserting the recording medium between the outer peripheral surface of the transfer roller and an outer peripheral surface of the pressure roller at the second area. In addition, the electric field application device is configured to apply an electric field between the transfer roller and the pressure roller.

In a sixth aspect of the present invention, in the transfer inkjet printer device of the fifth aspect, the transfer roller has a configuration in which an elastic layer composed of urethane rubber is formed on an outer periphery of a roller base body having conductivity, and a surface of the elastic layer is covered with a fluorine-based resin.

In a seventh aspect of the present invention, the transfer inkjet printer device of any one of the first to sixth aspects further includes a cleaner used to remove residual ink on the intermediate transfer surface of the intermediate transfer body at a position in a downstream side of the second area and in an upstream side of the first area in the rotation route.

According to a transfer inkjet printer device of the present invention, a high-quality print image can be formed on a recording medium, wherein the print image is accurate and clear, the unevenness of color or shade is small, and the durability thereof is excellent. In addition, without reference to types of recording medium or to surface properties thereof, the high-quality print image as described above can be reliably and stably formed on various recording mediums.

DESCRIPTION OF EMBODIMENTS

Hereinafter, a transfer inkjet printer device of the present invention is described in detail with reference to the drawings.

Figure 1:
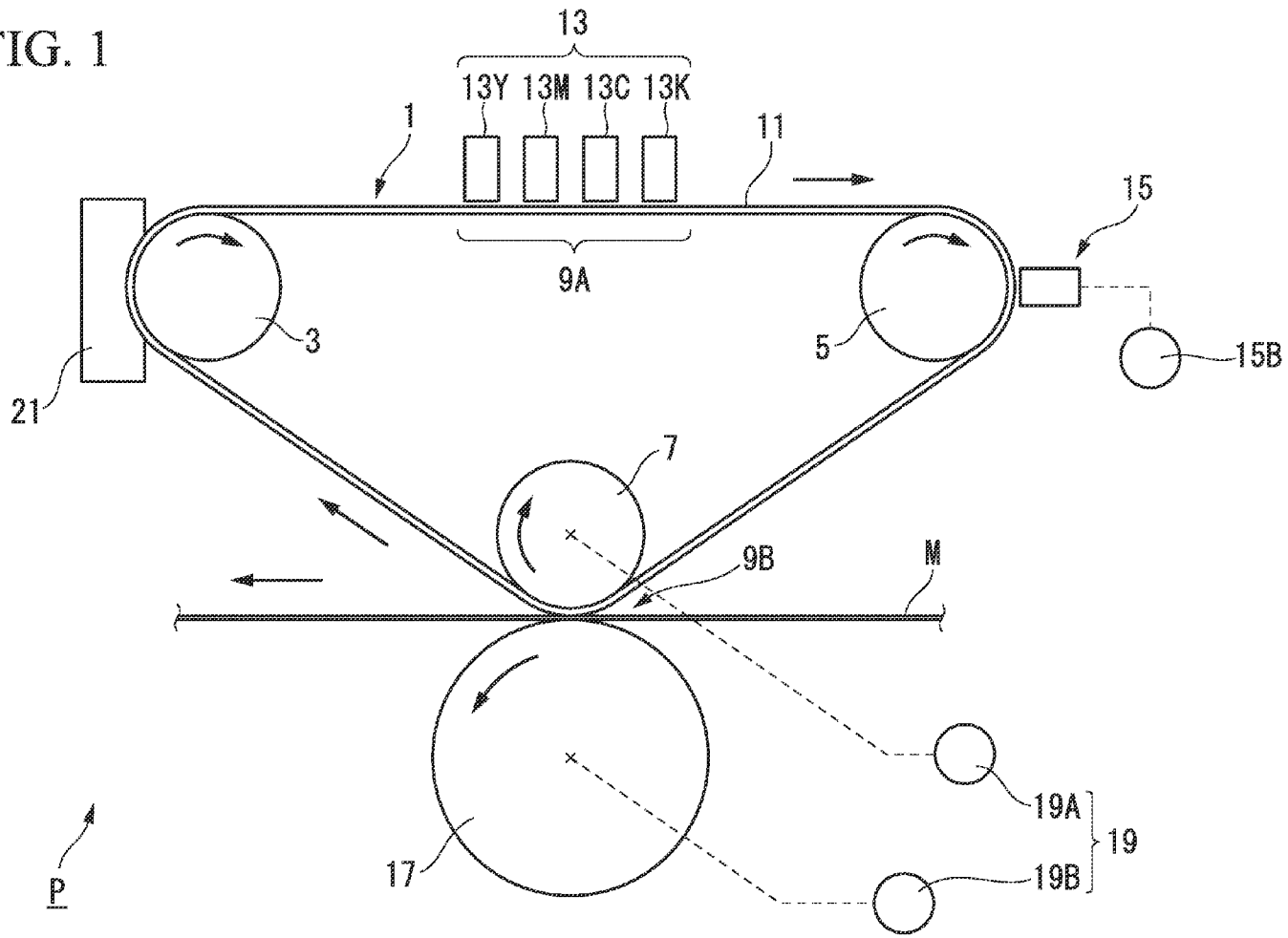
FIG. 1 is a schematic view showing a transfer inkjet printer device of a first embodiment of the present invention.
Figure 2:
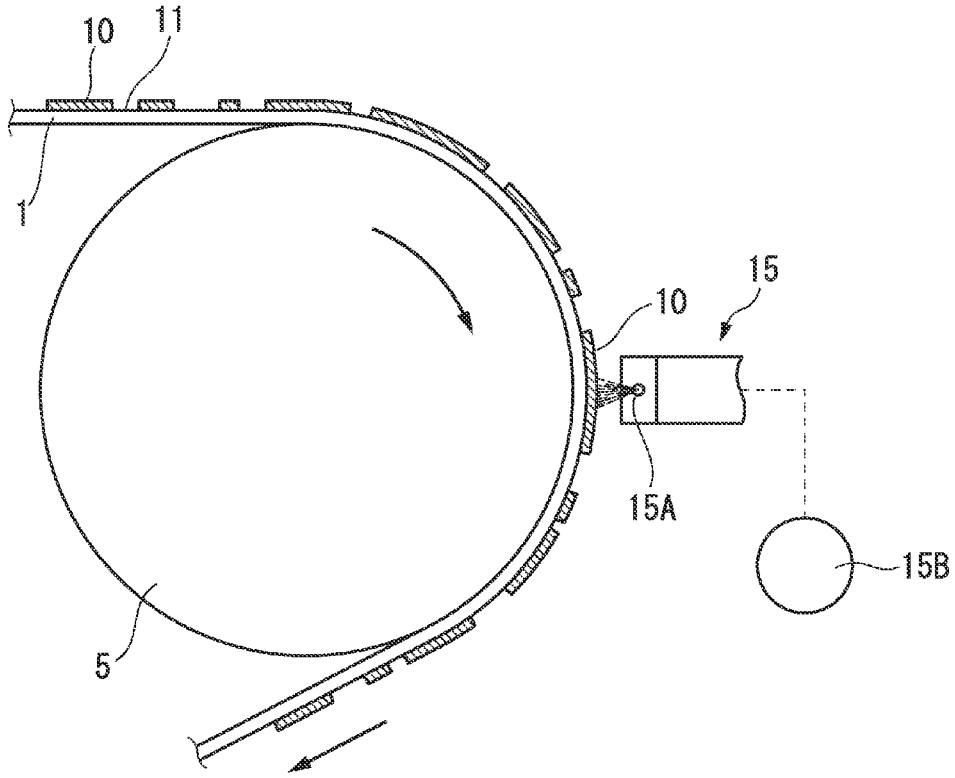
FIG. 2 is an enlarged view of the vicinity of a charged area in the transfer inkjet printer device shown in FIG. 1.
Figure 3:
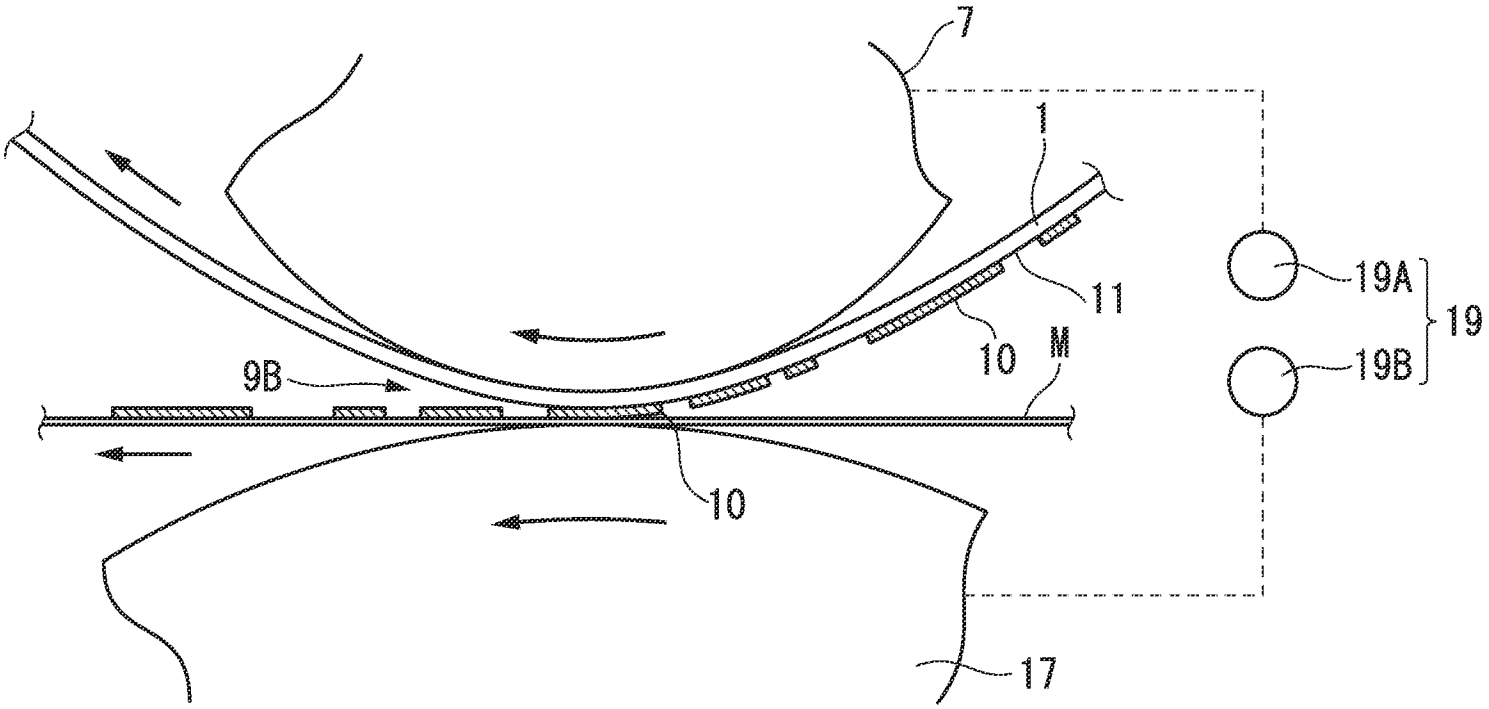
FIG. 3 is an enlarged view of the vicinity of a second area in the transfer inkjet printer device shown in FIG. 1.

FIGS. 1 to 3 show a transfer inkjet printer device P of a first embodiment of the present invention used to form a print image such as pictures or characters on the surface of a recording medium M as an object to be printed such as a paperboard, carton paper, a resin sheet, or cloth using a transfer belt 1 as an intermediate transfer body. In addition, the up-and-down direction in FIGS. 1 to 3 is the same as the vertical direction of the printer device.

The transfer inkjet printer device P includes the transfer belt 1 (intermediate transfer body), a first guide roller 3, a second guide roller 5, a support roller 7 (pressure device), an inkjet head 13, a charger 15, a pressure roller 17 (pressure device), an electric field application device 19, and a cleaner 21.

In FIG. 1, the transfer belt 1 is formed of an elastic strip-shaped body having an annular shape as a whole. The transfer belt 1 is wound on the first guide roller 3, the second guide roller 5, and the support roller 7 (described below), and is supported so as to be able to rotationally move along a route (rotation route) having an approximately triangle shape. The surface of the transfer belt 1 in the outside of the rotation route includes an intermediate transfer surface 11.

A constituent material of the transfer belt 1 is not particularly limited, but it is desirable to use a material being non-conductive, having appropriate elasticity, strength, ink resistance, and durability, and further having excellent ink removability at the surface thereof (the intermediate transfer surface 11). From this view point, it is desirable to employ a structure in which the base material of the transfer belt 1 is silicone rubber or urethane rubber, and the surface of the base material as the intermediate transfer surface 11 is covered with fluorine-based resin.

In the rotation route of the transfer belt 1, an intermediate area between the first and second guide rollers 3 and 5 in a route directly connecting the first and second guide rollers 3 and 5 is configured to be an intermediate image-forming area 9A (first area) at which an intermediate image is formed on the intermediate transfer surface 11 of the transfer belt 1 using the inkjet head 13. In addition, in the rotation route of the transfer belt 1, an area contacting the support roller 7 is configured to be a transfer area 9B (second area) at which the intermediate image on the intermediate transfer surface 11 is transferred onto the recording medium M.

The inkjet head 13 is disposed in the intermediate image-forming area 9A (first area) between the first and second guide rollers 3 and 5 so as to face the surface (the intermediate transfer surface 11) of the transfer belt 1. The inkjet head 13 discharges ink onto the intermediate transfer surface 11 of the transfer belt 1 in accordance with certain picture patterns or character patterns, wherein the ink is made by dispersing toner particles (colored particles) having a property to be charged in a liquid dispersion medium, and thus forms an ink layer as an intermediate image on the intermediate transfer surface 11.

It is sufficient if the specific configuration of the inkjet head 13 is similar to that of a head used in a general inkjet printing method of multi-color or single-color. For example, as shown in FIG. 1, in accordance with the CMYK system for multi-color printing, a configuration may be employed in which single-color heads 13Y, 13M, 13C, and 13K corresponding to four colors of Y (yellow), M (magenta), C (cyan), and K (black) respectively are arranged in the movement direction of the transfer belt 1. In addition, the inkjet head 13 may be composed only of one head for single-color printing. In FIG. 1, the inkjet head 13 is shown as a line head in which the transfer belt 1 passes under fixed heads, but may be configured to be a serial type in which a head moves (scanning move) in the width direction of the transfer belt 1.

In this embodiment, in ink layers 10 (refer to FIGS. 2 and 3) formed as intermediate images on the intermediate transfer surface 11 by discharging ink from the inkjet head 13, the toner particles (colored particles) in the ink layers 10 have been charged with a positive (+) charge beforehand. That is, the inkjet head of the inkjet printer device of the present invention is a recording head using a piezoelectric element such as a piezo element, and is configured to selectively discharge ink droplets beforehand charged onto an object (the transfer belt 1 of this embodiment) from nozzles depending on recording signals. Therefore, the toner particles in the ink layers 10 on the surface of the transfer belt 1 have been charged beforehand.

It is sufficient if the toner particles used in ink are pigment particles having a property to be charged used in pigment-based ink. Specific types, components, or composition thereof is not particularly limited. In addition, with respect to a dispersion medium allowing toner particles to be dispersed therein, in order to discharge the dispersion medium from the nozzle of the inkjet head, and in order to electrophorese toner particles in the dispersion medium of ink layers at the transfer area 9B (second area) (described below), it is desirable that the dispersion medium be non-conductive and have a low viscosity of approximately 10 cps or less.

In the rotation route of the transfer belt 1, the charger 15 is disposed in an intermediate position between the intermediate image-forming area 9A (first area) and the transfer area 9B (second area) at which the intermediate image on the intermediate transfer surface 11 is transferred onto the recording medium M, that is, in a position in the downstream side of the inkjet head 13 in the movement direction of the transfer belt and in the upstream side of the support roller 7 in the movement direction of the transfer belt. The charger 15 is a device used to increase the charge amount (electric charge amount) of the toner particles in the ink layers 10 composing the intermediate images formed on the surface (the intermediate transfer surface 11) of the transfer belt 1, and used to ensure and stabilize the charged state thereof. The charger 15 in this embodiment is provided in the vicinity of the transfer belt 1 wound around the second guide roller 5 so as to face the surface (the intermediate transfer surface 11) of the transfer belt 1.

The specific configuration of the charger 15 is not particularly limited, but in general, it is preferable to employ a configuration of using corona discharge. For example, as shown in FIG. 2, a configuration is conceivable in which a linear electrode 15A extending in the width direction of the transfer belt 1 is provided, and the second guide roller 5 being conductive (e.g., formed of metal) is used as a counter electrode to the linear electrode 15A. In this case, a power unit 15B applies voltage (high voltage) between the linear electrode 15A and the second guide roller 5, corona discharge is generated between the linear electrode 15A and an outer peripheral surface of the second guide roller 5, and thus the toner particles in the ink layers 10 on the surface of the transfer belt 1 positioned in the electric field of the corona discharge are charged.

In addition, although it is not shown in the drawings, a configuration may be employed in which needle electrodes having tips thereof facing the surface of the transfer belt are arranged in the width direction of the transfer belt, corona discharge is generated between the tips of the needle electrodes and an outer peripheral surface of the second guide roller 5, and thus the toner particles on the surface of the transfer belt positioned in the electric field of the corona discharge are charged.

The second guide roller 5 can adopt a configuration in which a surface-coating layer being non-conductive is formed on the outer peripheral surface of a roller base body composed of metal or the like having conductivity. In this case, the conductive roller base body is used as the counter electrode, and voltage (high voltage) is applied between the linear electrode 15A (or the needle electrodes) and the roller base body.

The charging of toner particles by the charger 15 is performed using charge of the same polarity as the charge polarity of the toner particles in the ink layers 10 of the intermediate images at the time the ink layers are formed by discharging ink from the inkjet head 13. That is, in this embodiment, since the toner particles in the ink layers 10 of the intermediate images at the time being formed have a positive (+) charge as described above, the charger 15 charges the toner particles with a positive (+) charge.

In the rotation route of the transfer belt 1, the pressure roller 17 as a pressure device is disposed in the transfer area 9B (second area) at which the intermediate image on the intermediate transfer surface 11 is transferred, that is, in an area in which the transfer belt 1 is wound around the support roller 7, wherein the axis direction of the pressure roller 17 is parallel to that of the support roller 7. The pressure roller 17 is a member referred to as an impression cylinder in a general transfer printing method. The transfer belt 1 and the recording medium M such as paper are inserted between the pressure roller 17 and the support roller 7 in a state where the transfer belt 1 and the recording medium M are lapped on each other, to be mechanically pressed, and thus the intermediate image on the intermediate transfer surface 11 of the transfer belt 1 is transferred onto the surface of the recording medium M. That is, the support roller 7 and the pressure roller 17 are configured to be the pressure device of the present invention.

The electric field application device 19 is provided in order to form an electric field in the transfer area 9B (second area), and in order to electrophorese the charged toner particles in the ink composing the intermediate image on the intermediate transfer surface 11 of the transfer belt 1 toward the surface of the recording medium M using the electric field. In this embodiment, DC power supplies 19A and 19B are configured to apply voltage to the support roller 7 and to the pressure roller 17 respectively, an electrical potential difference is generated between the rollers 7 and 17, and thus an electric field is formed between the rollers 7 and 17. In addition, in this embodiment, the electric field application device 19 is set so that the support roller 7 has a higher electrical potential than that of the pressure roller 17. For example, the electric field application device 19 is configured to apply positive voltage to both so that the potential of the support roller 7 is 1000 to 2000 V and the potential of the pressure roller 17 is 100 to 800 V, and is configured so that the positive (+) charged toner particles are electrophoresed from the support roller 7 toward the pressure roller 17 using the electrical potential difference between the rollers 7 and 17.

The electric field application device 19 is configured so that the electric field formed in the transfer area 9B by the above voltage application is formed in an approximately perpendicular direction to the facing direction between the support roller 7 and the pressure roller 17, that is, to the surface of the recording medium M.

In this way, by setting the electrical potential difference between the DC power supplies 19A and 19B of the electric field application device 19, the positive (+) charged toner particles in the ink layer 10 of the intermediate image are electrophoresed toward the pressure roller 17 in the electric field, that is, toward the surface of the recording medium M, and therefore the toner particles are gathered in a position in the ink layer 10 near the recording medium M. By combining the concentration effect toward the recording medium M using the electrophoresis like this with the effect of the above-described mechanical pressure, as described below in detail, the intermediate image is reliably and stably transferred onto the surface of the recording medium M, and thus a high-quality image as a final print image being accurate and clear and having high durability is formed on the recording medium M.

Furthermore, in the rotation route of the transfer belt 1, the cleaner 21 is disposed in a position in the downstream side of the transfer area 9B (second area) in which the pressure roller 17 and the support roller 7 are positioned and in the upstream side of the intermediate image-forming area 9A (first area) in which the inkjet head 13 is positioned, wherein the cleaner 21 is used to remove remaining ink on the surface (the intermediate transfer surface 11) of the transfer belt 1. In this embodiment, the cleaner 21 is disposed in a position facing the first guide roller 3.

The specific configuration of the cleaner 21 is not particularly limited, but it is sufficient if the cleaner 21 has a configuration similar to that of a cleaner used in a transfer inkjet printer in the related art. For example, a configuration may be employed in which a cleaning agent, a solvent or the like is applied or sprayed onto the surface of the transfer belt 1 using a roll coater or the like, subsequently a wiping roller, a blade having flexibility, or the like wipes it out, and further if necessary, dry air is blown thereon.

An overall transferring and printing process of the transfer inkjet printer device P of the above-described first embodiment is described below.

In the rotation route, the transfer belt 1 is wound on the first guide roller 3, the second guide roller 5, and the support roller 7, and rotationally moves in clockwise of FIG. 1. At the position being wound around the support roller 7, that is, at the transfer area 9B (second area), the transfer belt 1 is inserted between the support roller 7 and the pressure roller 17.

On the other hand, the continuous sheet-shaped recording medium M such as a paperboard, carton paper, a resin sheet, or cloth is continuously supplied to the transfer area 9B (second area) from the right side of FIG. 1 and is inserted and pressed between the support roller 7 and the pressure roller 17 while contacting the intermediate transfer surface 11 of the transfer belt 1. Thereafter, the recording medium M is continuously moved (released) leftward in connection with the counter-clockwise rotation of the pressure roller 17 and with the leftward movement of the transfer belt 1.

When the transfer belt 1 reaches the intermediate image-forming area 9A (first area), ink in which toner particles (colored particles) charged with a positive (+) charge beforehand are dispersed in a liquid dispersion medium is discharged onto the surface (the intermediate transfer surface 11) of the transfer belt 1 from the inkjet head 13 (e.g., four colors of single-color heads 13Y, 13M, 13C, and 13K) in accordance with certain picture patterns or character patterns, and thus an intermediate image is formed on the intermediate transfer surface 11. That is, ink layers 10 including the toner particles (colored particles) charged with a positive (+) charge are formed into certain patterns on the intermediate transfer surface 11.

When a portion of the transfer belt 1 in which the intermediate image is formed as described above reaches the charger 15, the charge amount (electric charge amount) of the toner particles in the ink layer 10 composing the intermediate image is increased by the charger 15, and the charged state thereof is ensured and stabilized.

Furthermore, when the portion of the transfer belt 1 in which the intermediate image is formed reaches the transfer area 9B (second area), the transfer belt 1 and the recording medium M such as paper are inserted between the pressure roller 17 and the support roller 7 in a state where the transfer belt 1 and the recording medium M are lapped on each other, to be mechanically pressed, and thus the intermediate image on the intermediate transfer surface 11 of the transfer belt 1 is transferred onto the surface of the recording medium M. At the same time, the electric field application device 19 forms an electric field between the pressure roller 17 and the support roller 7, the electric field electrophoreses the positive (+) charged toner particles in the ink layer 10 of the intermediate image toward the pressure roller 17, that is, toward the surface of the recording medium M, and therefore the toner particles are gathered in a position in the ink layer near the recording medium M. By combining the concentration effect toward the recording medium M using the electrophoresis like this with the effect of the above-described mechanical pressure, the intermediate image is reliably and stably transferred onto the surface of the recording medium M, and thus as a final print image, a print image being accurate (clear) and having excellent adhesion to the recording medium is formed on the recording medium M.

That is, when the ink layer 10 of the intermediate image is transferred from the surface (the intermediate transfer surface 11) of the transfer belt 1 onto the surface of the recording medium, the charged toner particles in the ink layer 10 are gathered into a position in the ink layer near the surface of the recording medium using the electrophoresis as described above, and accordingly the density of the toner particles is increased at an area in the ink layer 10 to contact the surface of the recording medium. The ink layer 10 is pressed in this state, and thus the ink layer transferred on the surface of the recording medium becomes a dense layer in which toner particles are densified. In addition, since the toner particles in the ink layer 10 are always pushed in an approximately perpendicular direction to the surface of the recording medium M through the electrophoresis based on the formed electric field, it is possible to suppress the movement of the toner particles in a direction along the surface of the recording medium during pressing and to prevent blotting or the like on the recording medium M during pressing. Therefore, the intermediate image can be accurately transferred to the recording medium M. As a result, the final print image on the recording medium also becomes accurate and clear, the adhesion thereof to the surface of the recording medium is high, and the image has excellent durability. In addition, since the dense ink layer having a high density is transferred onto the surface of the recording medium, even if using a recording medium of a type or a surface property in which it is difficult to perform high-quality printing in a case of using a conventional method (a method of transfer using pressure only), it is possible to form a print image being accurate and clear and having excellent durability.

For example, even if using a fluffy recording medium having low surface smoothness, it is possible to advance toner particles into fine spaces between bumps or fluffs on the surface thereof by electrophoresis. In addition, even if using a recording medium with a surface having low wettability to ink, it is possible to advance toner particles into fine recesses on the surface of the recording medium by electrophoresis. Therefore, it is possible to form a print image being accurate and clear and having excellent durability on the recording medium. Accordingly, without reference to types of recording medium or to surface properties thereof, it is possible to widely perform high-quality printing on various recording mediums.

The recording medium M such as paper on which a print image has been formed is released to the left side of FIG. 1. On the other hand, the transfer belt 1 passed through the transfer area 9B (second area) after transferring an intermediate image reaches the cleaner 21. In the cleaner 21, residual ink on the surface (the intermediate transfer surface 11) of the transfer belt 1 is removed. The transfer belt 1 cleaned by passing through the cleaner 21 reaches the intermediate image-forming area 9A (first area) again. Then, as described above, ink in which charged toner particles are dispersed in a liquid dispersion medium is discharged onto the surface (the intermediate transfer surface 11) of the transfer belt 1 from the inkjet head 13 in accordance with certain picture patterns or character patterns, and thus an intermediate image is formed on the intermediate transfer surface 11. In this way, while the transfer belt 1 rotationally moves along the rotation route, the continuous printing is performed on the recording medium M such as paper.

In the above embodiment, the charger 15 is disposed in a position of the second guide roller 5 so as to face the surface of the transfer belt 1. However, it is sufficient if the charger 15 is disposed between the intermediate image-forming area 9A (first area) and the transfer area 9B (second area). For example, the charger 15 may be disposed between the second guide roller 5 and the inkjet head 13, or between the second guide roller 5, and the support roller 7 or the pressure roller 17. In this case, a configuration may be employed in which other than the second guide roller 5, a counter electrode (a metal roller, a metal plate or the like) formed of metal or the like and having conductivity is disposed so as to face the linear electrode or the needle electrodes described above and so as to be apart therefrom, the transfer belt 1 is let to pass between the counter electrode, and the linear electrode or the needle electrodes, and voltage (high voltage) is applied between the counter electrode, and the linear electrode or the needle electrodes.

Figure 4:
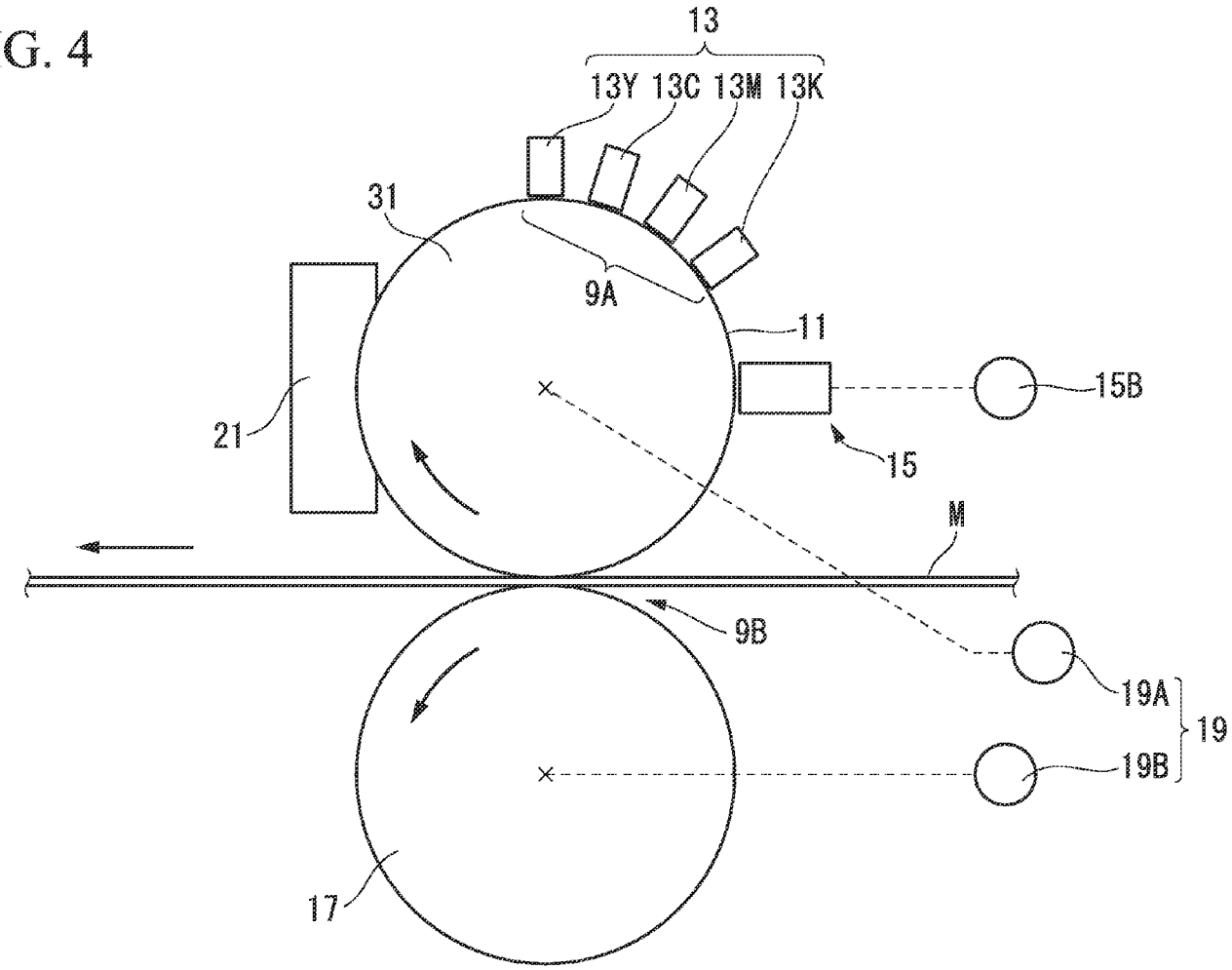
FIG. 4 is a schematic view showing a transfer inkjet printer device of a second embodiment of the present invention.

FIG. 4 shows a transfer inkjet printer device of a second embodiment of the present invention used to form a print image such as pictures or characters on the surface of a recording medium M as an object to be printed such as paper, a resin sheet, or cloth using a transfer roller 31 as an intermediate transfer body. In addition, the transfer roller 31 in FIG. 4 rotates, for example, clockwise.

In FIG. 4, the transfer roller 31 is a member configured by providing a material having elasticity and non-conductivity on at least a surface layer of a roller base body (drum base body) formed of metal or the like and having conductivity. The outer peripheral surface of the transfer roller 31 is configured to include the above intermediate transfer surface 11. That is, in a case where the intermediate transfer body is the transfer roller 31, the above-described rotation route corresponds to a route along the outer peripheral surface of the transfer roller 31 in the circumferential direction thereof.

Specifically, it is desirable that the transfer roller 31 have a configuration in which an elastic layer composed of urethane rubber as a material having appropriate elasticity and non-conductivity is formed on the outer peripheral surface of a roller base body (drum base body) composed of, for example, iron-based material or aluminum alloy, and further in order to provide ink removability thereon, the surface of the above elastic layer is covered by a fluorine-based resin.

In the entire outer peripheral surface (rotation route) of the transfer roller 31, an area shown in an upper part in FIG. 4 is set to be an intermediate image-forming area 9A (first area), and an area shown in a lower part in FIG. 4 is set to be a transfer area 9B (second area).

In the intermediate image-forming area 9A (first area), an inkjet head 13 is disposed so as to face the surface (the intermediate transfer surface 11) of the transfer roller 31. The inkjet head 13 can adopt a configuration similar to that of the inkjet head of the first embodiment shown in FIG. 1. That is, in the second embodiment shown in FIG. 4, ink including charged toner particles is also discharged onto the surface (the intermediate transfer surface 11) of the transfer roller 31 from the inkjet head 13 with certain patterns, and ink layers including charged toner particles are formed as an intermediate image on the surface of the transfer roller 31.

Furthermore, a charger 15 is disposed in a position in the rear side of the intermediate image-forming area 9A (first area) in the rotation direction of the transfer roller and in the front side of the transfer area 9B (second side) in the rotation direction of the transfer roller, so as to face the surface (the intermediate transfer surface 11) of the transfer roller 31. For example, a linear electrode 15A similar to the first embodiment may be disposed in the axis direction of the transfer roller 31 with a certain interval to the surface of the transfer roller 31. A power unit 15B applies voltage (high voltage) between the linear electrode 15A and the conductive roller base body of the transfer roller 31 used as a counter electrode, corona discharge is generated therebetween, and thus the toner particles on the surface of the transfer roller positioned in the electric field of the corona discharge may be charged. In addition, as described above, instead of the linear electrode 15A, needle electrodes having tips thereof facing the surface of the transfer roller are arranged in the axis direction of the transfer roller, corona discharge is generated between the tips of the needle electrodes and the transfer roller, and thus the toner particles positioned in the electric field of the corona discharge may be charged.

In the entire outer peripheral surface (rotation route) of the transfer roller 31, a pressure roller 17 (impression cylinder) is disposed in the transfer area 9B (second area) shown in a lower part in FIG. 4, wherein the axis direction of the pressure roller 17 is parallel to the axis direction of the transfer roller 31. The recording medium M such as paper is inserted between the pressure roller 17 and the transfer roller 31, to be mechanically pressed, and the intermediate image on the intermediate transfer surface 11 of the transfer roller 31 is transferred onto the surface of the recording medium M. That is, the pressure roller 17 of this embodiment is configured to be the pressure device of the present invention.

In addition, an electric field application device 19 is provided in order to form an electric field in the transfer area 9B (second area), and in order to electrophorese the charged toner particles in the ink layer composing the intermediate image on the intermediate transfer surface 11 of the transfer roller 31 toward the surface of the recording medium M. In this embodiment, the electric field application device 19 is configured so that DC power supplies 19A and 19B generate an electrical potential difference between the conductive base bodies of the transfer roller 31 and the pressure roller 17, and so that an electric field is formed therebetween.

In the outer peripheral surface (rotation route) of the transfer roller 31, a cleaner 21 is disposed in a position in the rear side of the transfer area 9B (second side) in the rotation direction of the transfer roller and in the front side of the intermediate image-forming area 9A (first area) in the rotation direction of the transfer roller, wherein the cleaner 21 is used to remove remaining ink on the surface (the intermediate transfer surface 11) of the transfer roller 31. The cleaner 21 can adopt a configuration similar to that of the cleaner described in the first embodiment.

The second embodiment shown in FIG. 4 includes a configuration in which the transfer belt 1 of the first embodiment shown in FIG. 1 is changed into the transfer roller 31. Accordingly, an overall specific process during printing, and operations and effects thereof are the substantially same as that of the first embodiment, and thus the descriptions thereof are omitted here.

In each embodiment described above, the charger 15 is disposed in an intermediate position between the intermediate image-forming area 9A (first area) and the transfer area 9B (second side). However, in a case where the toner particles in an ink layer at the time being discharged onto the transfer belt 1 (or the transfer roller 31) from the inkjet head 13 are sufficiently charged, or in a case where the charge of the toner particles is not excessively decreased while the ink layer of the intermediate image reaches from the intermediate image-forming area 9A (first area) up to the transfer area 9B (second side), the charger 15 can be omitted. In other words, in a case where the toner particles in an ink layer which have reached the transfer area 9B without receiving the charging action of the charger 15 hold the charge amount required for the above electrophoresis, the charger 15 can be omitted.

However, as shown in each embodiment, in a case where the charger 15 is disposed in an intermediate position between the intermediate image-forming area 9A (first area) and the transfer area 9B (second side), before an intermediate image on an intermediate transfer body is transferred onto a recording medium, the charger 15 can stabilize the charged state of toner particles in an ink layer 10 composing the intermediate image and can increase the charge amount thereof. Therefore, it is possible to reliably and stably perform the electrophoresis of toner particles during the transfer thereof. As a result, the movement of toner particles toward the surface of a recording medium and the concentration based on it are facilitated, and the densification of a final print image and the effect of increasing the durability are improved.

The invention claimed is:

1. A transfer inkjet printer device comprising:

an intermediate transfer body including an intermediate transfer surface capable of rotationally moving along a rotation route;

an inkjet head used to discharge ink made by dispersing toner particles having a property to be charged in a dispersion medium, onto the intermediate transfer surface of the intermediate transfer body at a first area in the rotation route in a state where the toner particles are charged, so as to form an intermediate image composed of an ink layer on the intermediate transfer surface;

a pressure device used to press the ink layer of the intermediate image on the intermediate transfer surface, onto a surface of a recording medium at a second area in a downstream side of the first area in the rotation route; and an electric field application device provided in the second area, wherein the electric field application device is configured to electrophorese the charged toner particles in the ink layer of the intermediate image on the intermediate transfer surface, toward the recording medium at the second area, the pressure device includes a first roller and a second roller, the first and second rollers being capable of rotating while the intermediate transfer surface and the recording medium are disposed therebetween at the second area in a state where the intermediate transfer surface and the recording medium overlap each other, in the second area, the second roller is disposed on a side of the recording medium opposite to the intermediate transfer surface, and the electric field application device is configured to form an electric field between the first and second rollers by applying to the first and second rollers, voltages whose polarities are the same as that of the charged toner particles, the electrical potential of the first roller being higher than the electrical potential of the second roller.

2. The transfer inkjet printer device according to claim 1, further comprising a charger used to charge the toner particles in the ink layer of the intermediate image on the intermediate transfer surface at a position in a downstream side of the first area and in an upstream side of the second area in the rotation route.

3. The transfer inkjet printer device according to claim 1 or 2, wherein the intermediate transfer body is composed of a strip-shaped transfer belt formed into an endless annular shape, and an outer surface of the transfer belt includes the intermediate transfer surface, and wherein the first and second rollers are configured to rotate while inserting the transfer belt and the recording medium therebetween at the second area in a state where the transfer belt and the recording medium overlap each other.

4. The transfer inkjet printer device according to claim 3, wherein the transfer belt has a configuration in which a surface of a base material formed of urethane rubber is covered with a fluorine-based resin.

5. The transfer inkjet printer device according to claim 1 or 2, wherein the intermediate transfer body is composed of the cylindrical first roller, and an outer peripheral surface of the first roller includes the intermediate transfer surface.

6. The transfer inkjet printer device according to claim 5, wherein the first roller has a configuration in which an elastic layer composed of urethane rubber is formed on an outer periphery of a roller base body having conductivity, and a surface of the elastic layer is covered with a fluorine-based resin.

7. The transfer inkjet printer device according to claim 1, further comprising a cleaner used to remove residual ink on the intermediate transfer surface of the intermediate transfer body at a position in a downstream side of the second area and in an upstream side of the first area in the rotation route.

8. The transfer inkjet printer device according to claim 1, using the dispersion medium having a low viscosity of 10 centipoise or less.

9. The transfer inkjet printer device according to claim 1, wherein the electric field application device is configured to electrophorese the charged toner particles in the ink layer of the intermediate image on the intermediate transfer surface, toward the recording medium at the second area, and to gather the toner particles in a position in the ink layer close to the recording medium, and the transfer inkjet printer device is configured so that the pressure device presses, onto the surface of the recording medium at the second area, the ink layer of the intermediate image formed on the intermediate transfer surface, in a state where the toner particles have been gathered in the position in the ink layer close to the recording medium by the electric field application device.

* * * * *